United States Patent [19]

Borthwick et al.

[11] 4,008,723

[45] Feb. 22, 1977

[54] SMOKING MIXTURE

[75] Inventors: James Borthwick, Glasgow; James Forrester Morman, Troon, both of Scotland

[73] Assignee: Imperial Chemical Industries Limited, London, England

[22] Filed: Mar. 11, 1975

[21] Appl. No.: 557,255

Related U.S. Application Data

[62] Division of Ser. No. 125,872, March 18, 1971, Pat. No. 3,885,574.

[30] Foreign Application Priority Data

Mar. 23, 1970 United Kingdom ..... 13860/70

[52] U.S. Cl. ..... 131/2

[51] Int. Cl.[2] ..... A24B 15/00

[58] Field of Search ..... 131/2, 17 R, 140 C, 131/15

[56] References Cited

UNITED STATES PATENTS 3,545,448 12/1970 Mormon ..... 131/2

*Primary Examiner*—Robert W. Michell
*Assistant Examiner*—V. Millin
*Attorney, Agent, or Firm*—Cushman, Darby & Cushman

[57] ABSTRACT

Tobacco substitute based smoking mixture containing a minimum amount of organic combustible material and a maximum amount of harmless inorganic filler, the composition of the filler having been selected so as to impart a commercially acceptable burning rate to the mixture.

13 Claims, No Drawings

SMOKING MIXTURE

This is a division, of application Ser. No. 125,872 filed Mar. 18, 1971 now Pat. No. 3,885,574.

This invention relates to smoking mixtures and to methods of producing such mixtures.

Smoking mixtures are systems by which desirable flavours and drugs are conveniently distilled or aerosoled to the mouth during the smoking action. Being of natural origin, tobacco contains many chemical species which, although necessary for the growth and survival of the plant, contribute nothing to the smoking enjoyment and may unfortunately be the precursors of chemicals which are injurious to health.

There have been many attempts to lessen the health hazard from tobacco smoking by adding to the tobacco, chemicals which are reputed to favourably change the chemical composition and biological activity of the smoke.

More recently, substitutes for tobacco have been claimed. See British Pat. Nos. 1,055,473 and 1,143,500 and U.S. Pat. No. 3,106,209 in which cellulose, oxidised cellulose and lettuce leaves are used. In these compositions, pretreatment and additives are claimed to affect the smoke so that it is acceptable tastewise and is less hazardous to health.

The ideal smoking substitute would be a material or 'fuel' which burns harmlessly to give the energy to distill, aerosol or pyrolytically produce and distill only the necessary amounts of those components required for taste and drug effects.

Unfortunately, fuels which burn to give only harmless products are difficult to find. The most obvious fuel would be elemental carbon which should combust to harmless carbon dioxide. Unfortunately again, the commercially available forms of carbon, e.g. carbon black, are prolific producers when smoked of polyaromatic hydrocarbons. A large part of these hydrocarbons may, of course, come from the impurities produced in the manufacture of these carbons.

An object of the present invention is to provide a smoking composition which is suitable for aerosoling flavours and drugs but which contains a minimum amount of combustible organic material or smoke-producing fuel which on burning inevitably gives rise to some harmful products.

According to the present invention there is provided a smoking mixture comprising an organic combustible material or fuel, a (on pyrolysis) harmless inorganic filler and a binder, the inorganic filler being present in quantities such as to considerably reduce the amount of harmful products produced on combustion of the mixture and the composition of the filler having been selected by ion balancing to impart a commercially acceptable burning rate to the smoking mixture.

The organic combustible material or fuel may comprise 15 to 80% by weight of the smoking mixture, preferably 20–30% by weight.

The harmless inorganic filler may comprise 15 to 65% by weight of the smoking mixture, preferably 40–60% by weight.

The mixture may also contain a plasticiser/humectant in addition to the binder.

From another aspect, the present invention is a method of manufacturing said smoking mixture comprising preselecting a specific organic combustible material as smoke-producing fuel and preselecting the proportion by weight of said combustible material to be incorporated in the smoking mixture, admixing said combustible material with a predetermined amount of harmless inorganic filler, the ionic content of which has been balanced to impart a commercially acceptable burning rate to said preselected amount of organic combustible material and finally forming a shaped article of the mixture utilising a binder.

The shaped article is preferably a film, extruded filament or tape.

For the purpose of this invention the term "harmless inorganic filler" is intended to include inorganic salts of some relatively simple organic acids. For example, formates, oxalates, tartrates and citrates can be used as "harmless inorganic fillers" but these are less satisfactory than the preferred completely inorganic materials on account of some undesirable pyrolytic decomposition. This decomposition becomes potentially more harmful as the size of the organic molecule increases.

The inorganic filler preferably comprises a mixture of two or more such "inorganic" salts admixed in quantities such as to obtain the balance of anions and cations most appropriate for imparting the desirable rate of combustion to the preselected amount of the specific organic combustible material incorporated in the smoking mixture.

By way of example, an acceptable rate of combustion for the smoking mixture of the invention can be correlated to the puff number of 10–12 of a machine-made standard Class B British cigarette containing 1.1 g. tobacco, where each puff is of 25 ml. volume in two seconds, followed by a 58 second rest or smouldering period and where the 70 mm. cigarette is smoked to a butt length of 20 mm.

The smoking mixture of the invention is intended to be used as a comparatively safe neutral substrate which burns at a correct rate and has a low content of relatively harmless organic fuel and a high content of harmless inorganic filler. Flavourants, drugs, medicaments, materials to improve ash coherence and colour and other additives, including tobacco, can be incorporated as desired to produce the final product sold to the smoker.

The smoking mixture containing such a high content of harmless inorganic material can advantageously be produced by a process similar to reconstituted tobacco processes which utilise film-forming agents or binders. Such a film-forming process enables a relatively large proportion of inorganic materials to be incorporated into the smoking mixture.

The film-forming agent or binder and the plasticiser/humectant incorporated in the mixture are also organic in nature but they may have an inorganic content and they can be carefully chosen from materials known to burn to produce lesser amounts of harmful products than tobacco.

Preferred binders include carboxymethyl cellulose and its salts and other carboxylated carbohydrates. Where the amount of binder employed is very small other less satisfactory binder materials such as natural gums, guar gums, locust bean gums and other synthetic binders such as methyl and other ethers of cellulose may be used.

Preferred plasticiser/humectants include glycerol, ethylene glycol and polyethylene glycol.

Organic combustible materials suitable as smoke-producing fuel in the mixtures of the invention include carbohydrates, modified carbohydrates and certain aldol condensation products. Carbon samples which produce lower amounts of polycyclic aromatic hydrocarbons can also be used.

The smoke-producing carbohydrate may advantageously comprise cellulose, cellulose derivatives, sugars, alginate or glucuronic acid.

The modified carbohydrate may advantageously be prepared as disclosed in our U.S. Pat. No. 1,113,979 by subjecting it to a catalysed degradation process at a temperature of 100°–250° C until the weight of the degraded material is less than 90% of the dry weight of the original carbohydrate.

Preferred degradation catalysts include sulphuric acid, sulphamic acid and ammonium sulphamate. The modified carbohydrate may be oxidised cellulose.

The aldol condensation products may advantageously be prepared as described in our U.K. Pat. Application No. 22270/69 by acid or based catalysed condensation of a compound of the formula R'λ $COCH_2CH_2COR^2$(I) (or a precursor thereof) wherein R'and $R^2$, which may be the same or different, each represent a hydrogen atom, or an alkyl, hydroxyalkyl or formyl group.

Preferably, the aldol condensation product comprises the condensate from succinaldehyde, acetonyl acetone or the condensate from a precursor of (I) which is a compound containing a furan ring structure.

A further object of the present invention is to utilise the combustion modifying properties of known inorganic fillers to reduce the quantity of health hazard chemicals in smoking compositions, this object being attained by reducing the amount of organic fuel in the smoking mixtures and making up the weight with said inert fillers.

The choice of the inert inorganic fillers to be incorporated in the smoking mixture determines the rate of combustion or how many normal puffs can be had from a given weight of the mixture.

The art of making an acceptable burning composition involves choosing the correct proportions of fillers which relatively promote or retard the combustion.

Earlier publications in the tobacco substitute field have suggested that burning control of tobacco substitutes is exerted through "hydrated metal salts". The use of such materials as alkali nitrates to improve the "fireholding" of tobacco blends is well known. It has also been suggested that potassium is an essential constituent for the proper burning of tobacco. It is our experience that the water content of tobacco substitutes has only a relatively small effect on the number of puffs given by a particular weight of cigarette but may determine whether a composition is glowproofed or burns satisfactorily. Hydrated and non-hydrated versions of the same salt can be used. On the other hand, we have found that burning control is strongly influenced by the nature of the combination of cations and anions present. This does not imply that the combustion rate is uninfluenced by other considerations such as fuel particle size or texture of the smoking material.

The art of retarding combustion without making a composition glowproof yet obtaining the correct puff count from a given weight of smoking mixture by the use of these inert fillers is another key to the success of the present invention. Combustion accelerators are combined with combustion retardants in proportions which give a desirable rate of combustion for a specific organic fuel and a particular amount thereof in the mixtures. Whilst this principle of the invention is described and illustrated herein with reference to commonly available inert fillers, this principle can be applied to any inorganic material which proves to be a safe filler for use in a smoking mixture.

It is impossible to specify that some ionic species retard while others accelerate glow combustion since some fuels do not sustain combustion in isolation. It suffices to say that we have found that with a number of fuels a number of commonly available acidic anions influence combustion rate and that the order of the retarding ability of a selection of them is formate<oxalate silicate<carbonate =chloride<sulphate<phosphate<borate. Isolated exceptions to these orders indicated can, however, be found. Amongst the cations the order is sodium=potassium<calcium<magnesium. With the cations it would appear their effect on the burning rate depends on their basicity, the most significant change being from calcium to magnesium.

This implies, for example, that in smoking mixtures which are identical except that A contains sodium sulphate and B contains the same proportion by weight of magnesium sulphate, A will burn away more quickly. Similarly, in two compositions identical except that A contains calcium carbonate and B contains calcium borate, Composition A will turn away more quickly than Composition B.

The fillers chosen should not have the power to retain excessive quantities of water, otherwise glowproofing will result.

It is preferable, but not essential, that the fillers should be insoluble in water. Calcium carbonate has been found to be a most useful agent for use as a combustion accelerator balanced against combustion retarding agents such as calcium orthophosphate ($CaHPO_4.2H_2O$), magnesite ($MgCO_3$), light basic magnesium carbonate ($3MgCO_3.Mg.(OH)_2.3H_2O$), and calcium sulphate ($CaSO_4.\frac{1}{2}H_2O$). Using these and other inorganic materials, films can be made which give shred with filling powers comparable to tobacco shred.

Although the above description and the Examples which follow illustrate the required balance of ions being obtained by varying the respective amounts of two inorganic salts, it is possible that a suitable rate of combustion for a smoking mixture could be attained using an optimum amount of a single inorganic salt as inert filler.

The main advantages of the smoking mixtures of the invention compared with earlier synthetic products and, of course, tobacco, are as follows:

a. The lower amounts of organic materials present mean that proportionately lower amounts of the harmful smoke products are formed whilst maintaining a desirable rate of combustion for the mixture. In this connection, tests carried out on smoking mixtures of the invention show a reduction in the benzpyrene content of the smoke and a reduction in other chemical species known or suspected to be harmful because of the reduced organic fuel content. Furthermore, the mixtures of the invention advantageously have the same burning characteristics as tobacco based smoking mixtures. They keep lit and continue to burn and they have the same rate of combustion as tobacco.

b. The lower amounts of organic materials present gave rise to lower amounts of any "odour off notes" which may arise from smoking these materials (e.g. the burnt paper note of cellulose). Lower amounts of added masking agents are required in these instances.

c. The process of the invention permits the use of fuels which were previously impossible to use on account of their physical properties, e.g. the high solubility and non-fibrous nature of sucrose, glucose and glucuronic acid. The high inorganic content gives "body" to the films of these materials which were previously unusable in smoking mixtures.

The principle of ion balancing of the inert fillers is illustrated in the following tables. According to this principle the specific fuel and the amount thereof to be used in the mixture are first selected and then ion balance tests are effected to determine the composition having the most desirable rate of combustion. As can be seen from the tables the ions are investigated separately to ascertain their relative suitabilities for the selected fuel.

Tables 1 to 5 illustrate the comparative retarding powers of cations of various inert fillers when added to a smoking mixture of the following composition:

| | % by weight |
|---|---|
| Thermally degraded cellulose* | 53 |
| SCMC | 10 |
| Glycerol | 14 |
| Calcium carbonate | 5 |
| Citric acid | 4 |
| Potassium citrate | 5 |
| Ammonium sulphate | 4 |

*The thermally degraded cellulose was prepared as follows and in accordance with the method described in our British Patent 1.0 part by weight of sheeted alphacellulose was immersed in a 5.0% aqueous solution of ammonium sulphamate and the pulp compressed between rolls to leave 1.0 part of solution in the pulp. The pulp was air-dried at 45° C and then heated at 240° C so that the pulp became black and the weight of the degraded material was 75% of the original weight of alphacellulose plus ammonium sulphamate. The black pulp sheet was allowed to cool and was then ground to a powder passing a 120 BSS sieve.

In each case the inorganic filler constituted 5% of the total weight of the smoking mixture. The effect of the basicity of the cation is clearly indicated in each table.

Table 1

| Filler | % added (by weight) | Basicity of cation | Puff number |
|---|---|---|---|
| $MgSO_4 . 7H_2O$ | 5 | | 23 |
| $CaSO_4 . ½H_2O$ | 5 | increasing | 14.5 |
| $K_2SO_4$ | 5 | | 14.3 |
| $Na_2SO_4$ | 5 | | 14.25 |

Table 2

| Filler | % added (by weight) | Basicity of cation | Puff number |
|---|---|---|---|
| $Mg_3(PO_4)_2$ | 5 | | 18.2 |
| $CaHPO_4 . 2H_2O$ | 5 | increasing | 16.0 |
| $Na_2HPO_4$ | 5 | | 16.0 |
| $Na_2HPO_4 . 12H_2O$ | 5 | | 15.0 |

Table 3

| Filler | % added (by weight) | Basicity of cation | Puff number |
|---|---|---|---|
| $CaB_4H_7$ | 5 | | 19.8 |
| $Na_2B_4O_7$ | 5 | increasing | 19.8 |
| $Na_2B_4O_7 . 10H_2O$ | 5 | | 17.0 |

Table 4

| Filler | % added (by weight) | Basicity of cation | Puff number |
|---|---|---|---|
| $MgCO_3$ | 5 | | 15.0 |
| $3MgCO_3 . Mg(OH)_2 . 3H_2O$ | 5 | increasing | 12.3 |
| $CaCO_3$ | 5 | | 9–10 |
| $Na_2CO_3$ | 5 | | 10–11 |

Table 5

| Filler | % added (by weight) | Basicity of cation | Puff number |
|---|---|---|---|
| $MgCl_2 . 6H_2O$ | 5 | | 13.0 |
| $CaCl_2$ | 5 | increasing | 11–12 |
| NaCl | 5 | | 10–11 |

Tables 6 to 8 illustrate the retardant properties of different anions. The same basic smoking mixture of Tables 1 to 5 was used in the tests for Tables 6 to 8.

Table 6

| Filler | % added | Effectiveness of anion | Puff number |
|---|---|---|---|
| $CaB_4O_7$ | 5 | | 19.8 |
| $CaHPO_4 . 2H_2O$ | 5 | | 16.0 |
| $CaSO_4 . ½H_2O$ | 5 | | 14.5 |
| $CaCO_3$ | 5 | decreasing | 12.0 |
| $CaCl_2 . 6H_2O$ | 5 | retardant | 11.5 |
| Ca Oxalate | 5 | properties | 11.0 |
| Ca Formate | 5 | | 9 |

Table 7

| Filler | % added | Effectiveness of anion | Puff number |
|---|---|---|---|
| $Na_2B_4O_7$ | 5 | | 19.8 |
| $Na_2HPO_4$ | 5 | decreasing | 16.0 |
| $Na_2SO_4$ | 5 | retardant | 14.25 |
| NaCl | 5 | properties | 10.8 |
| $Na_2CO_3$ | 5 | | 10.4 |
| $Na_2SiO_3$ | 5 | | 9.4 |

Table 8

| Filler | % added | Effectiveness of anion | Puff number |
|---|---|---|---|
| $Mg_3(PO_4)_2$ | 5 | | 18.2 |
| $MgSO_4 . 7H_2O$ | 5 | | 17.5 |
| $MgCO_3$ | 5 | decreasing | 15.0 |
| $MgCl_2 . 6H_2O$ | 5 | retardant | 13.0 |
| Mg Silicate | 5 | properties | 12.0 |
| Mg Oxalate | 5 | | 12.0 |
| Mg Formate | 5 | | 10.8 |

A second smoking mixture was prepared of similar composition to that utilised for the tests of Tables 1 to 8 but with 53 parts by weight thermally degraded cellulose replaced by 53 parts by weight carbon black as fuel. Tests similar to those of Tables 1 to 8 were carried out on the carbon black based smoking mixture and the results are indicated in the following Tables 1*a*, 2*a*, 4*a*, 6*a* and 8*a* which correspond respectively to Tables 1, 2, 4, 6 and 8. No Tables corresponding to Tables 3, 5 and 7 were produced.

Table 1a

| Filler | % added | Basicity of cation | Puff number |
|---|---|---|---|
| $MgSO_4 . 7H_2O$ | 5 | | 11.7 |
| $CaSO_4 . ½H_2O$ | 5 | increasing | 10.0 |
| $Na_2SO_4$ | 5 | | 8.5 |
| $K_2SO_4$ | 5 | | 8.3 |

Table 2a

| Filler | % added | Basicity of cation | Puff number |
|---|---|---|---|
| $Mg_3(PO_4)_2$ | 5 | | 16.7 |
| $CaHPO_4 . 2H_2O$ | 5 | increasing | 14.7 |
| $Na_2HPO_4$ | 5 | | 12.0 |
| $Na_2HPO_4 . 12H_2O$ | 5 | | 9.5 |

Table 4a

| Filler | % added | Basicity of cation | Puff number |
|---|---|---|---|
| $Mg . CO_3$ | 5 | increasing | 9.2 |
| $CaCO_3$ | 5 | | 6.7 |

Table 6a

| Filler | % added | Effectiveness of anion | Puff number |
|---|---|---|---|
| $CaHPO_4 . 2H_2O$ | 5 | | 14.7 |
| $CaSO_4 . ½H_2O$ | 5 | decreasing | 10.0 |
| Ca Oxalate | 5 | retardant | 9.2 |
| Ca Formate | 5 | properties | 7.0 |
| $CaCO_3$ | 5 | | 6.7 |

Table 8a

| Filler | % added | Effectiveness of anion | Puff number |
|---|---|---|---|
| $Mg_3(PO_4)_2$ | 5 | | 16.7 |
| $MgSO_4 . 7H_2O$ | 5 | | 11.7 |
| $MgCl_2 . 6H_2O$ | 5 | decreasing | 10.3 |
| $MgCO_3$ | 5 | retardant | 9.2 |
| Mg Silicate | 5 | properties | 9.0 |
| Mg Oxalate | 5 | | 8.6 |
| Mg Formate | 5 | | 7.8 |

The following Tables 9 and 9*a* illustrate the effect of the ratio of % $CaCO_3$: % $CaHPO_4.2H_2O$ on the puff number respectively of thermally degraded cellulose based smoking mixtures and carbon black based smoking mixtures. In the case of Table 9 it is to be noted that 15–17 is the correct puff number for hand rolled cigarettes made with commercially available hand rolling paper in contrast to machine made cigarettes which have a puff number of 12.

Table 9

| | | | | | | |
|---|---|---|---|---|---|---|
| % thermally degraded cellulose | 28 | 28 | 28 | 28 | 28 | 28 |
| % SCMC | 10 | 10 | 10 | 10 | 10 | 10 |
| % Glycerol | 14 | 14 | 14 | 14 | 14 | 14 |
| % $CaCO_3$ | 10 | 12 | 14 | 16 | 18 | 20 |
| % $CaHPO_4 . 2H_2O$ | 25 | 23 | 21 | 19 | 17 | 15 |
| % K citrate | 4 | 4 | 4 | 4 | 4 | 4 |
| % Citric acid | 4 | 4 | 4 | 4 | 4 | 4 |
| % $(NH_4)_2SO_4$ | 5 | 5 | 5 | 5 | 5 | 5 |
| Ratio $CaCO_3$ : $CaHPO_4 . 2H_2O$ | 1:2.5 | 1:1.92 | 1:1.5 | 1:1.19 | 1:0.94 | 1:0.75 |
| Puff number | — | 17–18 | 16–17 | 15–16 | 14–15 | 13–14 |
| | Glow-proofed → | | Correct puff numbers → | | too low puff number | |

The smoking mixtures above were hand rolled with paper commercially available in Britain for this purpose. For comparison purposes 1.1 g. hand rolled tobacco cigarettes give 15–17 puffs. 1.1 g. machine made cigarettes with the more porous paper used by United Kingdom cigarette manufacturers give 10–12 puffs.

Table 9a

| | | | | | | |
|---|---|---|---|---|---|---|
| % Carbon black | 28 | 28 | 28 | 28 | 28 | 28 |
| % SCMC | 10 | 10 | 10 | 10 | 10 | 10 |
| % Glycerol | 14 | 14 | 14 | 14 | 14 | 14 |
| % $CaCO_3$ | 10 | 12 | 14 | 16 | 18 | 20 |
| % $CaHPO_4 . 2H_2O$ | 25 | 23 | 21 | 19 | 17 | 15 |
| % K Citrate | 4 | 4 | 4 | 4 | 4 | 4 |
| % Citric acid | 4 | 4 | 4 | 4 | 4 | 4 |
| % $(NH_4)_2SO_4$ | 5 | 5 | 5 | 5 | 5 | 5 |
| Ratio $CaCO_3$ : $CaHPO_4 . 2H_2O$ | 1:2.5 | 1:1.92 | 1:1.5 | 1:1.19 | 1:0.94 | 1:0.75 |
| Puff number | 11–12 | 10–11 | 10 | 9–10 | 8–9 | 7–8 |
| | Correct puff No. range | | | too low puff No. | | |

The five compositions indicated in Table 9 and Table 9*a* as having a correct puff number constituted the first five Examples of smoking mixtures of the invention. Tables 9 and 9*a* thus serve to illustrate how the ion balancing principle of the present invention is applied.

Applying the principle illustrated in Tables 9 and 9*a* and utilising the information given in the earlier tables a further seven examples of smoking mixtures according to the invention were prepared, the compositions and preparations of which are illustrated in Examples 6 to 23 below.

In Examples 6 to 9 the organic fuel is thermally degraded cellulose prepared according to the method previously described with regard to Tables 1 to 9. In Examples 10 to 13 the organic fuels are respectively sucrose, glucose, alpha-cellulose and polygalacturonic acid.

In each of Examples 6 to 13 the final composition as aforesaid was reached after tests similar to those indicated in Tables 9 and 9*a* had been effected. The compositions actually illustrated in Examples 6 to 13 are those having the best puff numbers. Examples 14 to 23 illustrate further variations in the parameters of the invention.

EXAMPLE 6

5.38 parts thermally degraded cellulose powder, 4.26 parts powdered chalk, 7.10 parts powdered magnesium carbonate and 60 parts water were stirred together. 1.34 parts glycerol and 20 parts water were stirred together then added to the previous mixture. The whole was paddle-stirred together for 30 minutes.

The mixture was transferred to a Probst & Class mill and at a gap setting of 2, milled for 5 minutes. The gap was reduced to setting zero and the mixture milled for a further 5 minutes. At the end of this period, 1.92 parts SCMC were added quickly into the centre of the vortex and the slurry immediately discharged into a clean container then paddle-stirred for 15 minutes. Sufficient water was then added to reduce the viscosity to 55,000 cps.

Film material was made by spreading the slurry at 0.020 in. on a band-drier and drying by means of hot air at 150° C. The band speed was 19 ft. $min^{-1}$. The film material was shredded and processed satisfactorily on cigarette making machinery.

1.1 g. cigarettes gave 10 standard puffs. The smoke was mild to taste. Dry weight composition of Example 6:

| | % |
|---|---|
| Thermally degraded cellulose | 26.9 |
| SCMC | 9.6 |
| Glycerol | 6.7 |
| $CaCO_3$ | 21.3 |
| $MgCO_3$ | 35.5 |

EXAMPLE 7

5.38 parts thermally degraded cellulose powder, 3.84 parts powdered chalk, 6.72 parts powdered light basic magnesium carbonate and 60 parts water were stirred together. 1.36 parts glycerol, 0.78 part potassium citrate and 20.0 parts water were stirred together, then added to the previous mixture. The whole was paddle-stirred together for 30 minutes.

The mixture was transferred to a Probst & Class mill and at a gap setting of 2, stirred for 5 minutes. The gap was reduced to zero and the mixture milled for a further 5 minutes. At the end of this time, 1.92 parts SCMC were added quickly into the vortex and the slurry immediately discharged into a clean container. The slurry was paddle-stirred for 15 minutes. Sufficient water was then added to reduce the viscosity to 50,000 cps.

Film material was made by spreading the slurry at 0.020 in. on a band-drier and dried by hot air at 150° C. The band speed was 19 ft. $min.^{-1}$.

The film material was shredded and processed satisfactorily on cigarette making machinery.

1.1 g. cigarettes gave 10 standard puffs. The smoke was mild to taste.

Dry weight composition of Example 7:

| | % |
|---|---|
| Thermally degraded cellulose | 26.9 |
| SCMC | 9.6 |
| Glycerol | 6.7 |
| $CaCO_3$ | 19.3 |
| $3 . MgCO_3 . Mg(OH)_2 . 3H_2O$ | 33.6 |
| K Citrate | 3.9 |

EXAMPLE 8

4.08 parts thermally degraded cellulose powder, 4.32 parts powdered chalk, 5.75 parts calcium hydrogen orthophosphate and 60 parts water were stirred together. 2.33 parts glycerol, 0.57 part potassium citrate, 0.72 part citric acid, 0.57 part ammonium sulphate and 20 parts water were stirred together then added to the previous mixture. The whole was stirred together for 30 minutes.

The mixture was transferred to a Probst & Class mill and at a gap setting of 2 milled for 5 minutes. The gap was reduced to zero and the mixture milled for a further 5 minutes. At the end of this period 1.76 parts SCMC were quickly added into the centre of the vortex and the slurry immediately discharged into a clean container, then paddle-stirred for 15 minutes. The viscosity was 42.000 ops.

Film material was made by spreading the slurry at 0.010 in. on a band-drier and drying by means of hot air at 150° C. The band speed was 22 ft. $min.^{-1}$.

The film material was shredded and processed satisfactorily on cigarette making machinery.

1.1 g. cigarettes gave 10 standard puffs. The smoke was mild to taste.

Dry weight composition of Example 8:

| | % |
|---|---|
| Thermally degraded cellulose | 20.18 |
| SCMC | 8.33 |
| Glycerol | 11.67 |
| $CaCO_3$ | 21.62 |
| $CaHPO_4 . 2H_2O$ | 28.83 |
| K Citrate | 2.88 |
| Citric acid | 3.61 |
| $(NH_4)_2SO_4$ | 2.88 |

EXAMPLE 9

50 parts thermally degraded cellulose powder, 3.2 parts powdered chalk, 5.7 parts powdered magnesium carbonate, 0.95 part powdered bentonite and 70.0 parts water were stirred together. 1.25 parts glycerol, 0.7 part potassium citrate and 11.5 parts water were stirred together and then added to the previous mixture. The whole was stirred together for 15 minutes.

The mixture was transferred to a Probst & Class mill and at a gap setting of 2 milled for 5 minutes. The gap was now reduced to zero and the mixture milled for a further 5 minutes. At the end of this time, 1.7 parts SCMC were added quickly into the centre of the vortex and the slurry immediately discharged into a clean container. The slurry was paddle-stirred for 15 minutes and at the end of this period sufficient water as added to reduce the viscosity to 60,000 cps.

Film material was made by spreading the slurry at 0.020 in. on a band-drier and drying by means of hot air at 150° C. The band speed was 16 ft. $min^{-1}$.

The film material was shredded and processed satisfactorily on cigarette making machinery.

1.1 g. cigarettes gave 11 standard puffs. The smoke was mild to taste.

The dry weight composition of Example 9 was:

| | % |
|---|---|
| Thermally degraded cellulose | 26.9 |
| SCMC | 9.6 |
| Glycerol | 6.7 |
| $CaCO_3$ | 17.3 |
| $MgCO_3$ | 30.6 |
| Bentonite | 5.0 |
| K Citrate | 3.9 |

EXAMPLE 10

5.6 parts sucrose, 7.8 parts calcium carbonate, 2.0 parts light basic magnesium carbonate, 0.8 part potassium citrate, 1.1 parts citric acid and 0.8 part ammonium sulphate were stirred for half an hour with 68.6 parts of water. The mixture was transferred to a Probst & Class mill and at a gap setting of 2 milled for 5 minutes. The gap was reduced to setting zero and the mixture milled for a further 5 minutes. At the end of this time 2.0 parts SCMC were added quickly and the slurry discharged immediately into a container and paddle-stirred for 15 minutes. 11.3 parts of water were added to reduce the viscosity to 56,000 cps.

Film material was prepared by spreading the slurry at 0.018 in. on a band-drier and drying by means of air at 60° C. The band speed was 9 ft./min.

The film material was very sensitive to moisture. It could, however, be satisfactorily shredded and processed by cigarette making machinery if the relative humidity of the atmosphere was maintained at 58–60 RH and 60° F. Under these conditions the equilibrium moisture content of the shred was 6.3–6.8.

1.1 g. cigarettes gave 10 puffs. The smoke from the cigarettes was mild to taste.

The dry weight composition of Example 10 was:

| | |
|---|---|
| Sucrose | 28 |
| SCMC | 10 |
| $CaCO_3$ | 39 |
| Light basic Mg carbonate | 10 |
| K citrate | 4 |
| Citric acid | 5 |
| $(NH_4)_2SO_4$ | 4 |

EXAMPLE 11

5.5 parts glucose, 7.6 parts calcium carbonate, 2.0 parts light basic magnesium carbonate, 0.75 part potassium citrate, 0.75 part ammonium sulphate and 1.0 part citric acid were stirred for half an hour with 67.2 parts of water. The mixture was transferred to a Probst & Class mill and at a gap setting of 2 milled for 5 minutes. The gap was reduced to setting zero and the mixture milled for a further 5 minutes. At the end of this time 20 parts SCMC were added quickly and the slurry discharged immediately into a container and paddle-stirred for 15 minutes. 13.3 parts of water were added to reduce the viscosity to 60,000 cps.

Film material was prepared by spreading the slurry at 0.020 in. on a band drier and drying by means of air at 150° C. The band speed was 18 ft./min.

The film material was very sensitive to moisture. It could, however, be satisfactorily shredded and processed by cigarette making machinery if the relative humidity of the atmosphere was maintained at 53–55% RH and 60° F. Under these conditions the equilibrium moisture content of the shred was 5–6.

1.1 g. cigarettes gave 10 puffs. The smoke from the cigarettes was mild to taste.

Dry weight composition of Example 11:

| | % |
|---|---|
| Glucose | 28 |
| SCMC | 10 |
| $CaCO_3$ | 39 |
| Light basic Mg carbonate | 10 |
| K citrate | 4 |
| Citrate acid | 5 |
| $(NH_4)_2SO_4$ | 4 |

EXAMPLE 12

4.5 parts alpha-cellulose powder, 3.5 parts chalk, 5.1 parts calcium hydrogen orthosphosphate, 2.5 parts glycerol, 0.8 part citric acid, 0.7 part ammonium sulphate, 0.7 part potassium citrate and 71 parts water were stirred together for half an hour. The mixture was transferred to a Probst & Class mill and at a gap setting of 2 milled for 5 minutes. The gap was reduced to setting zero and the mixture milled for a further 5 minutes. At the end of this period 1.7 parts of SCMC were added quickly and the slurry discharged immediately into a container and paddle-stirred for 15 minutes. 9.5 parts of water were added to reduce the viscosity to 46,000 cps.

Film material was made by spreading the slurry at 0.012 in. on a band-drier and drying by means of hot air at 150° C. The band speed was 20 ft./min.

The film material was shredded and processed satisfactorily on cigarette making machinery.

1.1 g. cigarettes gave 10 standard puffs. The smoke from the cigarettes was mild.

The dry weight composition of Example 12 was:

| | % |
|---|---|
| Alpha-cellulose | 24.35 |
| SCMC | 8.7 |
| Glycerol | 12.3 |
| $CaCO_3$ | 17.4 |
| $CaHPO_4 . 2H_2O$ | 26.0 |
| K citrate | 3.5 |
| Citric acid | 4.25 |
| $(NH_4)_2SO_4$ | 3.5 |

EXAMPLE 13

2.04 parts of glycerol and 1.17 parts potassium citrate were dissolved in 250 mls. of water. 2.88 parts of SCMC were then added to the solution and stirred for 15 minutes. 8.07 parts of alginic acid, 10.08 parts of magnesium carbonate and 5.76 parts powdered chalk were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 11 standard puffs. The smoke was mild to taste.

| Dry weight composition:- | % |
|---|---|
| Alginic acid | 26.9 |
| Glycerol | 6.8 |
| SCMC | 9.6 |
| $CaCO_3$ | 19.2 |
| $MgCO_3$ | 33.6 |
| Potassium Citrate | 3.9 |

EXAMPLE 14

2.04 parts of glycerol and 1.17 parts of potassium citrate were dissolved in 150 mls. of water. 2.88 parts of SCMC were then added to the solution and stirred for 15 minutes. 8.07 parts of thermally degraded sucrose, 10.08 parts of magnesium carbonate and 5.76 parts of powdered chalk were mixed together in the dry state then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 10 standard puffs.

| Dry weight composition:- | % |
|---|---|
| Thermally degraded sucrose | 26.9 |
| Glycerol | 6.8 |
| SCMC | 9.6 |
| $CaCO_3$ | 19.2 |
| Potassium Citrate | 3.9 |
| Magnesite | 33.6 |

EXAMPLE 15

2.04 parts of glycerol and 1.17 parts of potassium citrate were dissolved in 150 mls. of water. 2.88 parts of sodium alginate were then added to the solution and stirred for 15 minutes. 8.07 parts of thermally degraded cellulose, 11.88 parts of magnesium carbonate and 3.96 parts powdered chalk were mixed together in the dry state then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 10 standard puffs. The smoke was mild to taste.

| Dry weight composition:- | % |
|---|---|
| Thermally degraded cellulose | 26.9 |
| Glycerol | 6.8 |
| Sodium Alginate | 9.6 |
| $CaCO_3$ | 13.2 |
| Potassium citrate | 3.9 |
| $MgCO_3$ | 39.6 |

EXAMPLE 16

2.04 parts of glycerol and 1.17 parts of potassium citrate were dissolved in 75 mls. of water. 2.88 parts locust bean gum were then added to the solution and stirred for 15 minutes. 8.07 parts of thermally degraded cellulose, 12.66 parts magnesium carbonate and 3.18 parts powdered chalk were mixed together in the dry state then added to the previous mixture. The whole was stirred for 1 hour.

Film material was made by spreading the slurry at 0.02 inches on glass plate and left to dry. The film material was humidified and shredded. Ten cigarettes were hand rolled with Imperial Verge paper.

1.1 g. cigarettes gave 10 standard puffs.

The smoke was mild to taste.

| Dry weight composition:- | % |
|---|---|
| Thermally degraded cellulose | 26.9 |
| Glycerol | 6.8 |
| Locust Bean Gum | 9.6 |
| $CaCO_3$ | 10.6 |
| Potassium Citrate | 3.9 |
| $MgCO_3$ | 42.2 |

EXAMPLE 17

2.04 parts glycerol and 1.17 parts potassium citrate were dissolved in 150 mls. of water. 2.88 parts methyl cellulose were then added to the solution and stirred for 15 minutes. 8.07 parts thermally degraded cellulose; 12.66 parts magnesium carbonate and 3.18 parts powdered chalk were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 11 standard puffs. The smoke was mild to taste.

| Dry weight composition:- | % |
|---|---|
| Thermally degraded cellulose | 26.9 |
| Glycerol | 6.8 |
| Methyl Cellulose | 9.6 |
| $CaCO_3$ | 10.6 |
| Potassium Citrate | 3.9 |
| $MgCO_3$ | 42.2 |

EXAMPLE 18

2.04 parts glycerol and 1.17 parts potassium citrate were dissolved in 150 mls. of water. 2.88 parts SCMC were then added to the solution and stirred for 15 minutes. 8.07 parts thermally degraded cellulose, 5.76 parts ferrous sulphate and 10.08 parts magnesium carbonate were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 11 standard puffs. The smoke was mild to taste.

| Dry weight composition:- | % |
|---|---|
| Thermally degraded cellulose | 26.9 |
| Glycerol | 6.8 |

-continued

| Dry weight composition:- | % |
|---|---|
| Potassium citrate | 3.9 |
| SCMC | 9.6 |
| $FeSO_4$ | 19.2 |
| $MgCO_3$ | 33.6 |

EXAMPLE 19

2.04 parts glycerol and 1.17 parts potassium citrate were dissolved in 150 mls. of water. 2.88 parts SCMC were then added to the solution and stirred for 15 minutes. 8.07 parts thermally degraded cellulose, 10.08 parts aluminium hydroxide and 5.76 parts powdered chalk were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 12 standard puffs. The smoke was mild to taste.

| Dry weight composition:- | % |
|---|---|
| Thermally degraded cellulose | 26.9 |
| Glycerol | 6.8 |
| Potassium citrate | 3.9 |
| SCMC | 9.6 |
| $CaCO_3$ | 19.2 |
| $AL(OH)_3$ | 33.6 |

EXAMPLE 20

2.04 parts glycerol and 1.17 parts potassium citrate were dissolved in 150 mls. of water. 2.88 parts SCMC were then added to the solution and stirred for 15 minutes. 8.07 parts thermally degraded cellulose, 7.56 parts magnesium carbonate and 8.16 parts titanium dioxide were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 10 standard puffs. The smoke was mild to taste.

| Dry weight composition:- | % |
|---|---|
| Thermally degraded cellulose | 26.9 |
| Glycerol | 6.8 |
| SCMC | 9.6 |
| Potassium citrate | 3.9 |
| Titanium dioxide | 27.2 |
| Magnesium carbonate | 25.2 |

EXAMPLE 21

2.04 parts glycerol and 1.17 parts potassium citrate were dissolved in 150 mls. of water. 2.88 parts SCMC were then added to the solution and stirred for 15 minutes. 8.07 parts thermally degraded cellulose, 11.28 parts magnesium carbonate and 4.56 parts aluminosilicate were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper.

1.1 g. cigarettes gave 12 standard puffs. The smoke was mild to taste.

| Dry weight composition:- | % |
|---|---|
| Thermally degraded cellulose | 26.9 |
| Glycerol | 6.8 |
| SCMC | 9.6 |
| Potassium citrate | 3.9 |
| Aluminosilicate | 15.2 |
| Magnesium carbonate | 37.6 |

What we claim is:

1. A smoking mixture in fabricated form comprising a. as smoke producing fuel a solid combustible tobacco substitute material which material is non-toxic on pyrolysis and is selected from the group consisting of carbohydrates selected from the group consisting of cellulose, sucrose, glucose or an alginate and aldol condensation products prepared by acid- or base- catalysed condensation of a compound of the formula $$R^1COCH_2.CH_2COR^2$$

or a precursor thereof wherein $R^1$ and $R^2$ which may be the same or different each represents a hydrogen atom or an alkyl, hydroxyalkyl or formyl group;

b. a harmless filler, and c. sufficient binder to enable the mixture to be fabricated, said filler being harmless on pyrolysis and present in a proportion of 40 to 65% by weight of the mixture and being selected from salts wherein the anion comprises formate, oxalate, citrate, tartrate, silicate, carbonate, chloride, sulphate, phosphate, borate, oxide, dioxide or aluminate and the cation comprises sodium, potassium, calcium, magnesium, iron or titanium, the combination of cations and anions in the filler being selected to impart a burning rate correlated to a puff number of 8–12 of a machine-made standard Class B British cigarette containing 1.1 g tobacco, where each puff is of 25 ml volume in two seconds, followed by a 58 second rest or smouldering period and where the 70 mm cigarette is smoked to a butt length of 20 mm.

2. A smoking mixture according to claim 1 wherein the smoke-producing fuel (a) is cellulose.

3. A smoking mixture according to claim 1 wherein the smoke-producing fuel (a) is sucrose.

4. A smoking mixture according to claim 1 wherein the smoke-producing fuel (a) is glucose.

5. A smoking mixture according to claim 1 wherein the smoke-producing fuel (a) is an alginate.

6. A smoking mixture according to claim 1 wherein the filler comprises calcium carbonate, calcium borate, sodium borate, calcium orthophosphate, calcium oxalate, iron sulphate, titanium dioxide, magnesium carbonate, sodium aluminosilicate, bentonite or aluminium hydroxide.

7. A smoking mixture according to claim 1 wherein the filler (b) comprises a mixture of calcium carbonate and a member of the group consisting of magnesite, light basic magnesium carbonate, calcium orthophosphate and calcium sulphate, and the binder (c) is carboxymethyl cellulose or salt thereof.

8. A smoking mixture according to claim 1 comprising a plasticiser/humectant in addition to the binder.

9. A smoking mixture according to claim 8 wherein the plasticiser/humectant comprises glycerol, ethylene glycol or polyethylene glycol.

10. A smoking mixture according to claim 1 wherein the binder is selected from the class consisting of carboxymethyl cellulose and its salts, other carboxylated carbohydrates, natural gum, guar gum, locust bean gum and cellulose ethers.

11. A method of manufacturing a smoking mixture according to claim 1 comprising preselecting a solid combustible tobacco substitute material as defined in claim 31 as smoke-producing fuel and preselecting the proportion by weight of said tobacco substitute material to be incorporated in the smoking mixture, admixing said tobacco substitute material with a predetermined amount of binder and a harmless filler selected from salts wherein the anion comprises formate, oxalate, citrate, tartrate, silicate, carbonate, chloride, sulphate, phosphate, borate, oxide, dioxide or aluminate and the cation comprises sodium, potassium, calcium, magnesium, iron or titanium, the filler being harmless on pyrolysis and present in a proportion of 40 to 65% by weight of the mixture, and the combination anions and cations in the filler being sufficient to impart a burning rate correlated to a puff number of 8–12 of a machine-made standard Class B British cigarette containing 1.1 g tobacco, where each puff is of 25 ml volume in two seconds, followed by a 58 second rest or smouldering period and where the 70 mm cigarette is smoked to a butt length of 20 mm, and finally fabricating a shaped article of the mixture utilizing a binder.

12. A method according to claim 11 wherein the shaped article is a film, extruded filament or tape.

13. A method according to claim 11 wherein the filler comprises calcium carbonate, calcium borate, sodium borate, calcium orthophosphate, calcium oxalate, iron sulphate, titanium dioxide, magnesium carbonate, sodium aluminosilicate, bentonite or aluminium hydroxide.

* * * * *